US008183489B2

(12) United States Patent
Öberg et al.

(10) Patent No.: US 8,183,489 B2
(45) Date of Patent: May 22, 2012

(54) CONTACT ELEMENT

(75) Inventors: Åke Öberg, Uppsala (SE); Peter Isberg, Västerås (SE)

(73) Assignee: ABB Research Ltd., Zürich (CH)

( * ) Notice: Subject to any disclaimer, the term of this patent is extended or adjusted under 35 U.S.C. 154(b) by 430 days.

(21) Appl. No.: 12/519,260

(22) PCT Filed: Dec. 14, 2007

(86) PCT No.: PCT/EP2007/063981

§ 371 (c)(1),
(2), (4) Date: Jun. 15, 2009

(87) PCT Pub. No.: WO2008/071793

PCT Pub. Date: Sep. 19, 2008

(65) Prior Publication Data

US 2010/0044345 A1 Feb. 25, 2010

Related U.S. Application Data

(60) Provisional application No. 60/874,960, filed on Dec. 15, 2006.

(51) Int. Cl.
*H01R 33/02* (2006.01)

(52) U.S. Cl. ..... 218/146

(58) Field of Classification Search ..... 218/122–128, 218/146

See application file for complete search history.

(56) References Cited

U.S. PATENT DOCUMENTS

| | | | | |
|---|---|---|---|---|
| 4,190,753 | A * | 2/1980 | Gainer | 218/130 |
| 4,229,631 | A * | 10/1980 | Arakawa et al. | 218/130 |
| 4,707,576 | A * | 11/1987 | Gessinger et al. | 218/18 |
| 4,743,718 | A * | 5/1988 | Santilli | 218/130 |
| 4,847,456 | A * | 7/1989 | Bamford et al. | 218/141 |
| 4,926,017 | A * | 5/1990 | Aoki et al. | 218/123 |
| 4,935,588 | A * | 6/1990 | Hess et al. | 218/123 |
| 6,836,627 | B2 * | 12/2004 | Kretschmann et al. | 399/82 |

FOREIGN PATENT DOCUMENTS

| | | |
|---|---|---|
| GB | 1124822 | 8/1968 |
| SE | 526833 C2 | 11/2005 |

OTHER PUBLICATIONS

PCT/ISA/210—International Search Report—May 9, 2008.
PCT/ISA/237—Written Opinion of the International Searching Authority—May 6, 2009.

* cited by examiner

*Primary Examiner* — Truc Nguyen
(74) *Attorney, Agent, or Firm* — Venable LLP; Eric J. Franklin

(57) ABSTRACT

An electric contact element for an arcing contact including a contact body arranged to be applied against a contact element. The contact body includes a $M_{n+1}AX_n$-material, wherein M is at least one transition metal, A is at least one element selected from group 13-17 in the periodic table, X is C and/or N, and n is 1,2,3 or higher. A method of making a contact element including a contact body including a $M_{n+1}AX_n$-material. Use of an electric contact element including a contact body including a $M_{n+1}AX_n$-material in an arcing contact.

19 Claims, 2 Drawing Sheets

CONTACT ELEMENT

CROSS-REFERENCE TO RELACTED APPLICATIONS

This application claims priority to U.S. provisional patent application 60/874,960 filed 15 Dec. 2006 is the national phase under 35 U.S.C. §371 of PCT/EP2007/063981 filed 14 Dec. 2007.

TECHNICAL FIELD

The present invention relates to a contact element for an arcing contact. The present invention also relates to a method for manufacturing a contact element for an arcing contact.

BACKGROUND ART

Arcing contacts are used in a wide range of electro technical applications such as circuit breakers, generator breakers, contactors, power interrupters, disconnectors, relays, vacuum interrupters, fuses, current limiters or selector switches.

In this description and subsequent claims arcing contacts refers to a contact element opening up or closing an electrical circuit under the formation of electrical arcs.

An ideal material for an arcing contact must be able to sustain a number of different physical phenomena, such as thermal shock, arc erosion/melting, welding, wear and corrosion.

In the present technology arcing contacts are, for example, made of metal-matrix composite materials composed of a high-conductivity metal such as Ag or Cu, in combination with a metal, such as W or Ni, or a ceramic with high melting point and/or hardening effect, for example $SnO_2$, WC, or graphitic carbon. Such materials are often expensive, and are not easy to optimize with regard to thermal shock, arc erosion/melting, welding, wear and corrosion.

Therefore, there is a need for a contact element for an arcing contact, the contact element comprising a contact material which is cheaper and that is easier to optimize with regard to, for example, thermal shock, arc erosion/melting, welding, wear and corrosion, compared to conventional materials for arcing contacts.

SUMMARY OF THE INVENTION

It is an object of the present invention to provide a contact element for an arcing contact being improved with respect to contact elements already known.

According to a first aspect of the invention this object is achieved by a contact element for an arcing contact.

An electric contact element for an arcing contact comprises a contact body arranged to be applied against a second electric contact element, wherein the contact body comprises a $M_{n+1}AX_n$-material, wherein M is at least one transition metal, A is at least one element selected from the group 13-17 in the periodical table, X is C and/or N, and n is 1,2,3 or higher. Examples of transition metals are Sc, Ti, V, Cr, Zr, Nb, Mo, Hf, Ta. Examples of A elements are Al, Si, P, S, Ga, Ge, As, Cd, In, Sn, Tl, Pb.

Advantageous embodiments of the invention will be clear from the description below.

At present there are about 60 known MAX-materials. This family of materials is mainly ceramic, but in addition they have physical properties that make them suitable as arcing contact materials. Those properties are, for example good thermal and electrical conductivity, ductile, chemical integrity, high melting point, easy to process and good machinability. Also, they can easily be combined with metals in composites. It has now been found that a MAX-material is especially suitable as a contact material for a contact body in arcing contacts, i.e. where an arc is formed when the contact is disconnected or connected. At an arcing/breaking contact interface thermal cracks may be formed in the contact surfaces due to thermal shock, the material in the contact surfaces is evaporated and molten droplets of the contact material is formed.

According to an embodiment of the invention the $M_{n+1}AX_n$-material is a $M_3AX_2$-material, such as $Ti_3SiC_2$.

According to an embodiment of the invention the $M_{n+1}AX_n$-material is a $M_2AX$-material, such as $Ti_2AlC$.

According to an embodiment of the invention the $M_{n+1}AX_n$-material is sintered powder. The grain size has preferably an average size in the interval 1 nm to 2 mm.

According to an embodiment of the invention the body comprises at least one of the following materials: a metal, a metal alloy, a ceramic or a polymer.

According to an embodiment of the invention the body comprises a magnetic material. This destabilizes or moves the arc which is a desired property of the contact material.

According to an embodiment of the invention the body comprises at least one of the following materials in the form of fibres: metal fibres, ceramic fibres, or carbon fibres.

The fibres are organic or inorganic. By adding carbon fibres or metal fibres the thermal conductivity and mechanical properties of the contact body are improved. By adding ceramic fibres the fusing point of the contact body is raised and thereby the resistance against an arc in the arcing contact.

According to an embodiment of the invention the body comprises at least one of the following: carbon nano-tubes or fullerenes. By mixing carbon nano-tubes or fullerenes with the MAX-material in the contact body welding is prevented at closing a circuit. This also improves the thermal conductivity in the contact body so that the heat transfer from the contact surface can be improved.

According to an embodiment of the invention the body comprises a film of at least one of the following materials: a ceramic, a polymer and a metal. Hereby the chemical and thermal properties of the contact element are improved. The thickness of the film is preferably in the interval of 0.1 nm to 500 μm.

According to an embodiment of the invention the film is covering at least part of the contact surface of the body adapted to contact the second contact element.

According to an embodiment of the invention the body comprises sintered powder and the film is arranged at least partly around the sintered powder grains. By covering the powder grains, at least partly, with ceramic or metal film a contact element with good corrosion properties, high fusing point and low electrical and thermal resistivity is achieved. By covering the powder, at least partly, with a polymer, such as Teflon plus a suitable additive, e.g. melamine cyanurate or vulcanized cellulose, a contact element which will have the ability to reduce an arc in the contact, when breaking or connecting the contact element and the second contact element, is achieved. When breaking or connecting the contact the polymer in the contact body develops a gas that reduces the arc.

According to an embodiment of the invention the body comprises a plurality of films. The films may be arranged around at least part of the powder grains in the sintered contact body or on at least part of the surface of the sintered contact body.

According to an embodiment of the invention at least part of the contact body is surface hardened. The surface hardening may be mechanical or thermal.

According to an embodiment of the invention at least part of surface of the contact body is treated by a chemical reaction.

According to an embodiment of the invention at least some of the powder grains in the sintered body have been modified by a chemical reaction, for example by oxidation.

According to an embodiment of the invention the thickness of the body in a direction perpendicular to the contact surface arranged to be applied against the second contact element is between 0.5 μm and 0.1 meter. A thickness in this interval makes it possible to use bulk material for the production of the contact body, which gives a cost efficient production of the contact element.

According to a second aspect of the invention the object is achieved by an arcing contact comprising an electric contact element according to any of the above embodiments, wherein the arcing contact comprises the second contact element. According to one embodiment the second contact element comprises a second contact body comprising a $M_{n+1}AX_n$-material, wherein M is at least one transition metal, A is at least one element selected from group 13-17 in the periodic table, X is C and/or N, and n is 1,2,3 or higher.

According to a third aspect of the invention the object of the invention is achieved by a method of manufacturing an electrical contact element for an arcing contact. A method for manufacturing an electrical contact element comprising a contact body arranged to be applied against a second contact element, comprising mixing powder of at least one $M_{n+1}AX_n$-material, wherein M is at least one transition metal, A is at least one element selected from group 13-17 in the periodical table, X is C and/or N, and n is 1,2,3 or higher, forming a contact body, sintering the body.

The contact body may be directly sintered into a single piece or by machining or forming the sintered body into the contact body. Also, several contact bodies may be formed from the component. The component is for example in the form of a rod or a disc.

According to an embodiment of the invention the MAX material is mixed with fibres of carbon, metal or a ceramic, before sintering of the body.

According to an embodiment of the invention the MAX material is mixed with a metal powder before sintering of the body.

According to one embodiment of the invention the sintered component is heat-treated so that materials in the body react chemically.

According to one embodiment of the invention the material for the contact body is extruded and/or worked in a hot or cold condition. This can be done before sintering of the body or instead of sintering the body.

According to a fourth aspect of the invention the object of the invention is achieved by the use of an electrical contact element.

BRIEF DESCRIPTION OF DRAWINGS

The invention will be described in greater detail by way of examples and with reference to the accompanying drawings, wherein.

DESCRIPTION OF PREFERRED EMBODIMENTS

Figure 1:
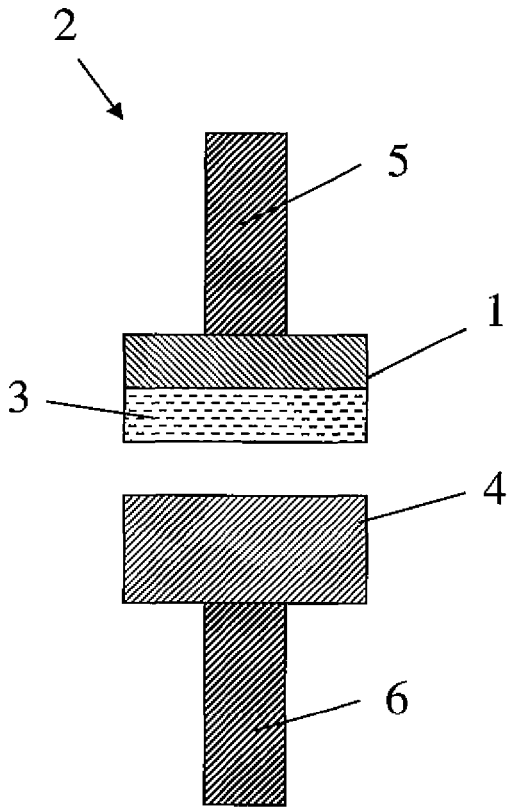
FIG. 1 illustrates very schematically a contact element according to an embodiment of the invention.

FIG. 1 very schematically shows a contact element 1 for an arcing contact 2 according to the present invention, where the contact element 1 comprises a contact body 3. The contact body 3 constitutes the part of the contact element 1 making or breaking contact to a second contact element 4. The first contact element 1 and the second contact element 4 are arranged opposite each other and arranged at the end of a first and second conductor 5,6, respectively. The contact body 3 consists of a $M_{n+1}AX_n$-material. During opening or closing of the contact an electric arc is formed between the first and second contact element 1,4.

Figure 2:
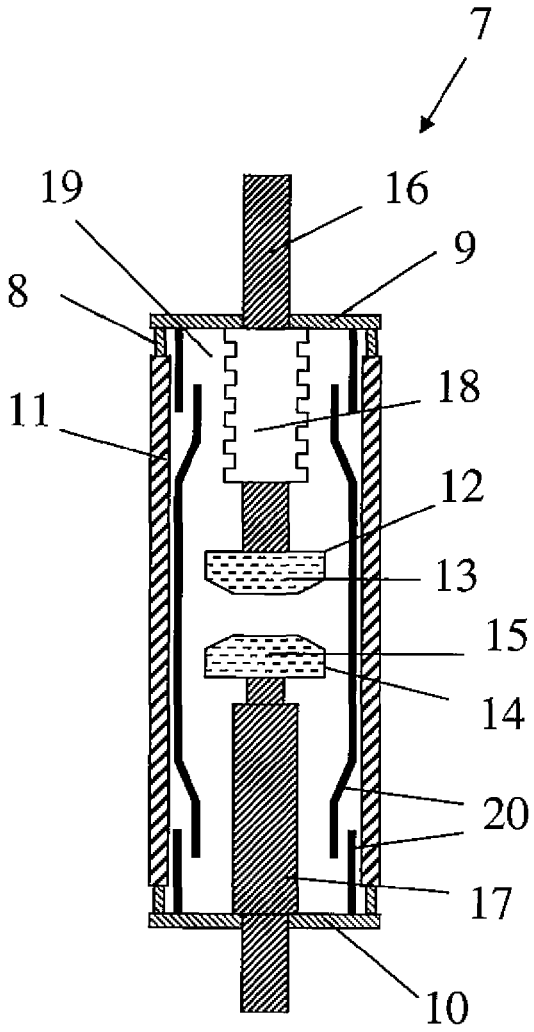
FIG. 2 is a cross section of a contact element according to one embodiment of the invention in a medium voltage vacuum interrupter.

FIG. 2 is a cross section of a contact element 12 according to one embodiment of the invention applied in a medium voltage vacuum interrupter 7. The vacuum interrupter 7 comprises a vacuum insulated vessel 8 having metallic end plates 9, 10 and a cylindrical insulating wall 11 arranged between the end plates. The cylindrical insulating wall and the end plates are enclosing a volume 19 that is hermetically sealed. The volume 19 comprises a first contact element 12 comprising a first contact body 13. The first contact body 13 constitutes the part of the contact element 12 making or breaking contact to a second contact body 15 of a second contact element 14. The first contact element 12 and the second contact element 14 are arranged opposite each other and arranged at the end of a first and second conductor 16, 17, respectively. Usually the contact elements 12, 14 are arranged at the conductors 16,17 by soldering. The first conductor 16 is connected with the end plate 9 through bellows 18 enabling movement along the longitudinal axis of the first conductor 16 without breaking the vacuum in the vessel B. An arc shield system 20 is arranged inside the insulating walls to prevent metallic contamination and thereby preventing flash-overs. According to this embodiment the first and the second contact bodies 13,15 consists of a $M_{n+1}AX_n$-material. During opening and closing of the contact an electrical arc is formed.

The contact body 3,13 constitutes the part of the contact element 1,12 making contact to a second contact element 4,14. The contact elements 1,12 according to two embodiments above are suitable for low as well as high voltage circuit breakers.

Figure 3:
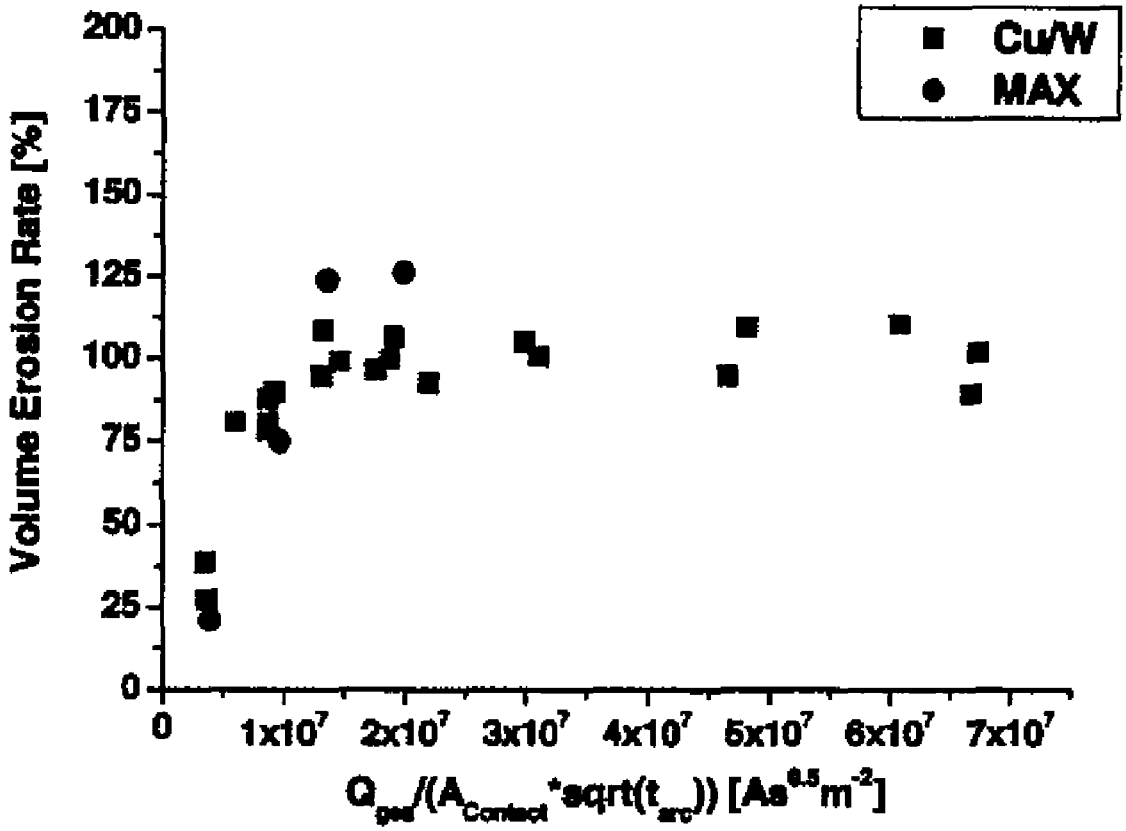
FIG. 3 is a diagram comparing volume erosion (%) for a conventional arcing contact material with a MAX-material in a contact element according to the invention.

FIG. 3 is a diagram showing a comparison of volume erosion (%) for a contact element according to the invention comprising a MAX-material and a Cu/W-material which is a conventional material for arcing contacts. The MAX-material in the diagram is $Ti_2AlC$. The conventional Cu/W-material comprises 80 wt % W and 20 wt % Cu. From the diagram it can be seen that the volume erosion (%) of the $Ti_2AlC$-material is comparable to the volume erosion (%) of the conventional Cu/W-material.

The arc in the arcing contact may be reduced by self-blast, gassing material from the contact element or magnetic manipulation of the arc.

The invention is of course not in any way limited to the preferred embodiment described above; several possibilities to modifications thereof should on the contrary be evident to a person skilled in the art, without deviating from the basic idea of the invention as defined in the appended claims.

The contact element according to the invention can be used in arcing contacts in a wide range of applications such as circuit breakers, generator breakers, contactors, power interrupters, disconnectors, relays, vacuum interrupters, fuses, current limiters, selector switches.

For example, the electrical contact element according to the invention can be used in all types of contacts, such as electronic contacts, power contacts, stationary contacts, breaking contacts, sliding contacts including brushes. Also, the contact body could be a material very similar to a $M_{n+1}AX_n$-material, with similar chemical, physical and mechanical properties, such as a ternary or a binary ceramic material, e.g. a Ti—C compound, or any mixture of the following materials: a $M_{n+1}AX_n$-material, a ternary and a binary ceramic material.

The material in the contact body of the contact element may also be used in other components in a breaker requiring the same material characteristics as the contact element.

The invention claimed is:

1. An electric contact element for an arcing contact, comprising:

a contact body arranged to be applied against a contact element, wherein the contact body comprises a $M_{n+1}AX_n$-material, wherein M is at least one transition metal, A is at least one element selected from group 13-17 in the periodic table, X is C and/or N, and n is 1, 2, 3 or higher.

2. The electrical contact element according to claim 1, wherein said $M_{n+1}AX_n$-material is a $M_3AX_2$-material.

3. The electrical contact element according to claim 1, wherein said $M_{n+1}AX_n$-material is a $M_2AX$-material.

4. The electrical contact element according to claim 1, wherein said $M_{n+1}AX_n$-material is made from sintered powder grains.

5. The electrical contact element according to claim 1, wherein said body comprises at least one of a metal, a metal alloy, a ceramic or a polymer.

6. The electrical contact element according to claim 1, wherein said body comprises a magnetic material.

7. The electrical contact element according to claim 1, wherein said body comprises at least one of the following materials in the form of fibres:

metal fibres, ceramic fibres, or carbon fibres.

8. The electrical contact element according to claim 1, wherein said body comprises at least one of the following: carbon nano-tubes or fullerenes.

9. The electrical contact element according to claim 1, wherein said body comprises a film of at least one of the following materials: a ceramic, a polymer and a metal.

10. The electrical contact element according to claim 1, wherein the thickness of the body in a direction perpendicular to the contact surface is between 0.0005 and 0.1 meter.

11. The electrical contact element according to claim 1, further comprising any of the following arcing or breaking contacts: circuit breakers, generator breakers, contactors, power interrupters, disconnectors, relays, vacuum interrupters, fuses, current limiters, selector switches.

12. The electrical contact element according to claim 1, wherein said $M_{n+1}AX_n$-material is $Ti_3SiC_2$.

13. The electrical contact element according to claim 1, wherein said $M_{n+1}AX_n$-material is $Ti_2AlC$.

14. The electrical contact element according to claim 9, wherein said film is covering at least part of the contact surface of the body making contact to the second contact element.

15. The electrical contact element according to claim 9, wherein the body comprises sintered powder grains and the film is arranged at least partly around the sintered powder grains.

16. An arcing contact, comprising:

a first electric contact element comprising a contact body arranged to be applied against a second contact element, wherein the contact body comprises a $M_{n+1}AX_n$-material, wherein M is at least one transition metal, A is at least one element selected from group 13-17 in the periodic table, X is C and/or N, and n is 1, 2, 3 or higher, wherein the arcing contact comprises the second contact element.

17. The arcing contact according to claim 16, wherein the second contact element comprises a second contact body comprising a $M_{n+1}AX_n$-material, wherein M is at least one transition metal, A is at least one element selected from group 13-17 in the periodic table, X is C and/or N, and n is 1, 2, 3 or higher.

18. A method of manufacturing electrical contact element for an arcing contact comprising a contact body arranged to be applied against a contact element, the method comprising:

mixing powder of a $M_{n+1}AX_n$-material, wherein M is at least one transition metal, A is at least one element selected from group 13-17 in the periodic table, X is C and/or N, and n is 1, 2, 3 or higher, forming a body, sintering the body, and machining of the sintered body.

19. The method according to claim 18, wherein the $M_{n+1}AX_n$-material is mixed with fibres of carbon, metal or a ceramic, before sintering the body.

* * * * *